US011058592B2

(12) United States Patent
Saxon

(10) Patent No.: US 11,058,592 B2
(45) Date of Patent: Jul. 13, 2021

(54) APPARATUS FOR VICTIM EXTRICATION, TRANSPORT, AND METHOD OF USE

(71) Applicant: RescueX, LLC, Denver, CO (US)

(72) Inventor: Brian Saxon, Denver, CO (US)

(73) Assignee: RESCUE X, LLC., Denver, CO (US)

( * ) Notice: Subject to any disclaimer, the term of this patent is extended or adjusted under 35 U.S.C. 154(b) by 53 days.

(21) Appl. No.: 16/390,868

(22) Filed: Apr. 22, 2019

(65) Prior Publication Data

US 2019/0350779 A1 Nov. 21, 2019

Related U.S. Application Data

(60) Provisional application No. 62/728,417, filed on Sep. 7, 2018, provisional application No. 62/660,799, filed on Apr. 20, 2018.

(51) Int. Cl.

| | |
|---|---|
| ***A61G 1/044*** | (2006.01) |
| ***A61G 1/02*** | (2006.01) |
| ***A61G 1/048*** | (2006.01) |
| ***A62B 3/00*** | (2006.01) |

(52) U.S. Cl.

CPC ..... *A61G 1/044* (2013.01); *A61G 1/02* (2013.01); *A61G 1/0231* (2013.01); *A61G 1/048* (2013.01); *A62B 3/00* (2013.01); *A61G 2200/30* (2013.01); *A61G 2200/58* (2013.01)

(58) Field of Classification Search

CPC ..... A61G 1/044; A61G 1/0231; A61G 1/048; A61G 1/02; A61G 1/0206; A61G 1/0225; A61G 2200/30; A61G 2200/58; A61G 1/0212; A61G 1/0218; A61G 1/025; A61G 1/0256; A61G 1/0262; A61G 1/00; A61G 1/007; A62B 3/00; A62B 35/0006; B63C 9/02

See application file for complete search history.

(56) References Cited

U.S. PATENT DOCUMENTS

| | | | | |
|---|---|---|---|---|
| 4,485,504 | A * | 12/1984 | Lehmann | A61G 1/06 5/628 |
| 5,179,746 | A * | 1/1993 | Rogers | A61G 1/04 280/47.29 |
| 7,530,126 | B2 * | 5/2009 | Thompson | A61G 1/00 128/870 |
| 2003/0200972 | A1 * | 10/2003 | Crutchfield | A61G 1/00 128/845 |
| 2007/0157390 | A1 * | 7/2007 | Molinaro | A61G 1/013 5/626 |
| 2010/0122416 | A1 * | 5/2010 | Bandel | A61G 1/056 5/626 |

(Continued)

OTHER PUBLICATIONS

American Heart Association/American Stroke Association; Fact Sheet: Systems of Care for Acute Cardiovascular Conditions; pp. 1-3; Jul. 2013; www.heart.org/policyfactsheets.

*Primary Examiner* — Nicholas F Polito
*Assistant Examiner* — George Sun
(74) *Attorney, Agent, or Firm* — Voz Patents, LLC

(57) ABSTRACT

The present invention is directed to an apparatus resembling a rescue backboard for the extrication of individuals in scenarios wherein the individual requires attention, such as medical attention. In particular, the invention surrounds an apparatus and method for the extrication of an individual requiring medical attention from a water-borne environments.

18 Claims, 8 Drawing Sheets

(56) References Cited

U.S. PATENT DOCUMENTS

| | | | | |
|---|---|---|---|---|
| 2011/0177733 | A1* | 7/2011 | Grimes | A61G 1/02 441/80 |
| 2011/0185504 | A1* | 8/2011 | Kenalty | A61G 1/044 5/626 |
| 2012/0151679 | A1* | 6/2012 | Kenalty | A61G 1/044 5/628 |
| 2012/0180218 | A1* | 7/2012 | Augustijn | A61G 1/007 5/626 |
| 2013/0015629 | A1* | 1/2013 | Bengtzen | A45C 9/00 280/30 |
| 2014/0083347 | A1* | 3/2014 | Taylor | B63C 13/00 114/263 |
| 2017/0112692 | A1* | 4/2017 | Arimura | A61G 1/0212 |
| 2018/0000665 | A1* | 1/2018 | Piccolo-Wignall | A61F 5/055 |

* cited by examiner

APPARATUS FOR VICTIM EXTRICATION, TRANSPORT, AND METHOD OF USE

CROSS REFERENCE TO REFERENCE TO RELATED APPLICATIONS

This application claims the benefit of U.S. Provisional Patent Application 62/660,799 entitled "APPARATUS FOR VICTIM EXTRICATION, TRANSPORT, AND METHOD OF USE" filed on Apr. 20, 2018; and U.S. Provisional Patent Application 62/728,417 entitled "APPARATUS FOR VICTIM EXTRICATION, TRANSPORT, AND METHOD OF USE" filed on Sep. 7, 2018—the entire contents of which are incorporated herein by reference in its entirety for all purposes.

FIELD OF THE INVENTION

The present invention is directed to an apparatus resembling a rescue backboard for the extrication of individuals in scenarios wherein the individual requires attention, such as medical attention. In particular, embodiments surround an apparatus and method for the extrication of an individual requiring medical attention from a water-borne environment.

BACKGROUND OF THE INVENTION

Preparing an individual for movement, transportation, or continuing medical attention is often coordinated with the stabilization of a victim prior to movement. Stabilizing a victim ensures that the victim can be attended to and moved, without unduly further inuring the individual when doing so. It will be appreciated that the term "victim" as used herein, refers to an individual requiring attention, particularly medical attention. A victim may require medical attention due to a variety of reasons. Events which result in a victim requires medical attention include, but are not limited to, any medical condition that renders a person immobile or unconscious including, but not limited to—myocardial infarction, seizure, stroke, diabetic issue or any other medical reason.

Providing immediate medical attention to a victim has been directly correlated to the effectiveness and timeliness of the attention provided by a rescuer such as a first aider, a first responder or other medical professional. It will be appreciated that at first aider, as referred to herein, is an individual who provides assistance to a victim, with care provided to preserve life, prevent a condition from worsening, or to promote recovery. It will be further appreciated that a first responder, as referred to herein, refers to a person with specialized training who is among the first to arrive and provide assistance at the scene of an emergency surrounding at least one victim. For instance, the American Heart Association has published statistics relating victims suffering from a sudden cardiac arrest with witnessed ventricular fibrillation. In such scenarios, if CPR (cardiopulmonary resuscitation) and defibrillation administered between 3-5 minutes of collapse, this can result in a survival rate of greater than 50% for the victim. (Facts, When Minutes Matter: Systems of Care for Acute Cardiovascular Conditions [online]. American Heart Association, 013 [retrieved on 2018-04-17]. Retrieved from the Internet: <URL: https://www.heart.org/idc/groups/heart-public/@wcm/@adv/documents/downloadable/ucm_304794.pdf>.)

SUMMARY OF THE INVENTION

The present invention is directed toward an apparatus and method for the extrication of a victim from a water-borne environment prior to and during the rescue process during which attention such as CPR, and other medical attention can be provided.

Existing solutions include the use of what is commonly referred to as a backboard or a spineboard. A backboard, typically approximately 182.9 cm (72 inches) in length, is designed to provide rigid support during movement of a person with suspected spinal or limb injuries. They are most commonly used by first responders such as ambulance staff, as well as lifeguards and ski patrollers.

A common shortcoming of a standard backboards of the prior art surrounds the size of the backboard. Although beneficial in certain scenarios for the carrying of a victim from a recovery location to a treatment location, the size of such backboards is limiting in areas where access is limited. Transporting a victim commonly requires 4 persons capable of walking and carrying a portion of the full weight of the victim for transportation of the victim. The carrying of a victim on a standard backboard commonly requires egress allowing for the width of the backboard as well as those carrying it. Furthermore, commonly used backboards commonly measure approximately 182.9 cm (72 inches) inches or longer in length in order to fully support the victim and all extremities. As a result of this length, standard backboards are often cumbersome to navigate around corners and through tight quarters. Time associated with readjusting a victim to navigate tight quarters can be detrimental to the prognosis and survival of the victim.

It is an aspect of the present invention to allow a single person to transport a victim from a recovery location to treatment location without the assistance of additional personnel. It is a further aspect of the present invention to allow the navigation around corners and through narrow pathways while maintaining the victim in a consistent position. However, it will be appreciated that embodiments of the present invention may comprise a board having a length of less than 182.9 cm (72 inches), or greater than or equal to 182.9 cm (72 inches) while in keeping with the spirit and scope of the present invention.

Existing backboards typically comprise a solid plastic form, or a molded plastic form with hollow cavities throughout the entirety of the backboard. Where these embodiments of previously existing solutions fall short, involves the extrication of a victim from a water-borne environment. Backboards constructed from solid plastic are denser than water and are negatively buoyant, thus the backboard sinks and results in difficulty in securing the victim to the board in a water-borne environment prior to extrication causing delay in extricating. Furthermore, backboards which are negatively buoyant may pose a drowning risk to the victim once the victim is secured to such a backboard. Those backboards that have hollow cavities throughout the entirety of the backboard result in a highly buoyant backboard. A highly buoyant backboard is problematic when attempting to secure the victim to the board, as the board is difficult to control when disposed beneath the victim as it wants to come to the surface. In some situation, this can cause the victim to roll off the backboard which in turn causes delays extrication and poses a further drowning risk to the victim.

Certain embodiments of the present invention provide limited buoyancy through buoyancy features. It is an aspect of the present invention to provide limited buoyancy configured to maintain a water extrication board to remain underneath a victim while an individual affixes the victim to the water extrication board without raising the center of gravity of the victim.

It is an aspect of the present invention to provide a water-extrication board directed toward the extrication of a victim from a water-borne environment while substantially decreasing the extrication time, therefore allowing first aiders and first responders to provide attention more rapidly.

Certain embodiments of the present invention surround the use of a water-extrication board having a length of approximately 121.9 cm (48 inches) or less.

Certain embodiments of the present invention comprise rails which serve to assist in the extrication of a victim from locations such as water-borne environments. Rails also provide a standoff from the ground which more easily allows for an individual to dispose their hands within a carry handle.

In certain embodiments, a board further comprises limited buoyancy. It will be appreciated that although high buoyancy is not desired in water rescue scenarios, some buoyancy can be helpful. Limited buoyancy allows an individual providing attention to a victim to focus on the fixation of the water-extrication board to the victim while the board remains in place under the victim due to the limited buoyancy.

In certain embodiments, it may be desired to affix a roller or wheels to assist in the transition of the victim from a recovery location to a treatment location. For instance, transporting a victim once extracted out of the water, to a location suited for providing medical attention.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

DETAILED DESCRIPTION OF VARIOUS EMBODIMENTS

Figure 1:
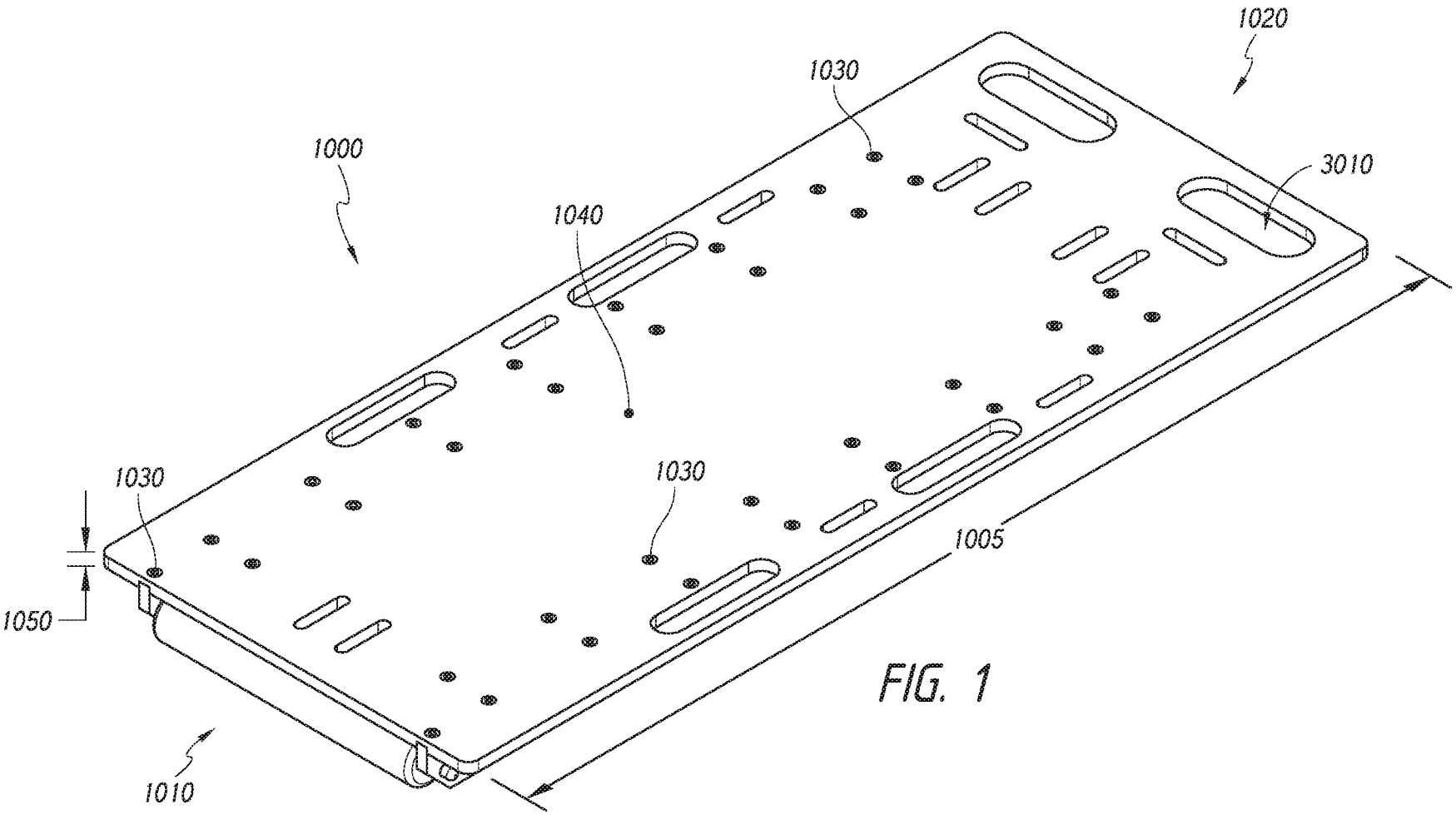
FIG. 1—A top perspective view of certain embodiments
Figure 2:
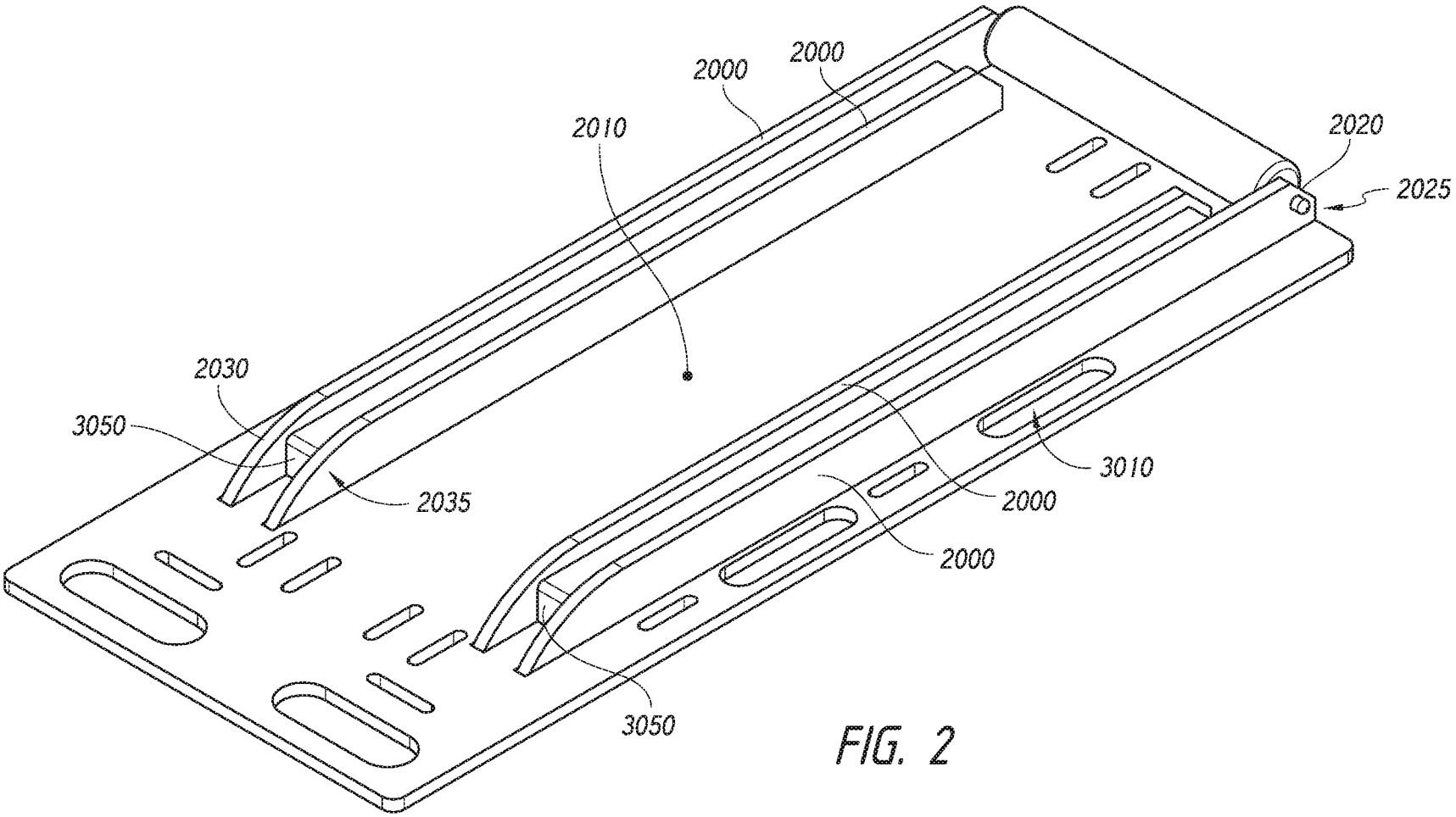
FIG. 2—A bottom perspective view of certain embodiments

Certain embodiments of the present invention, as seen in FIG. 1-FIG. 2, comprise a board 1000, having an oblong shape. In certain embodiments, it is desired that the board have a length 1005 configured to support a victim's head, back and buttocks. By supporting these regions of a victim, a rescuer is able to secure a victim for transport to a location suitable for victim treatment. In certain embodiments, it is further desired for the board 1000 to terminate inferior to a victim's buttocks. In such embodiments, it will be appreciated that a board 1000 having a length 1005 of 121.9 cm (48 inches) or less is sufficient to support the majority of victims from their head to their buttocks.

Certain embodiments, as seen in FIG. 1-FIG. 2, comprise a first rail 2000 and a second rail 2000 which protrude from a first surface 2010 of the board. The rails 2000 extend from a first end 1010 of the board, toward a second end 1020 of the board. Certain embodiments comprise rails 2000 which are affixed to the first surface 2010 of the board utilizing fasteners 1030 which extend from a second surface 1040 of the board, through the thickness 1050 of the board, and protrude from the first surface 2010 of the board and into the rails 2000. Certain embodiments comprise rails 2000 having a chamfer 2020 at a first end 2025 of the rails, and a taper 2030 at a second end 2035 of the rails. The taper 2020 of the second end is configured to prevent catching on structures when pulling a victim from an environment such as a pool. In certain embodiments, the rails 2000 are affixed to the first surface 2010 of the board, and the victim is tethered to the second surface 1040 of the board.

In certain embodiments, such as shown in FIG. 3-FIG. 7, rails 2000 extending from the first surface 2010 of the board provide an offset 3000 from the ground allowing rescuers to access handles 3010 without expending effort to space the first side 2010 of the board in order to dispose their hands through the handles 3010. Although the board 1000 and rails 2000 may be constructed from rigid materials, semi-rigid materials, or flexible materials alike, it will be appreciated that the board 1000 and rails 2000 of certain embodiments comprise a rigid material to provide a stable and rigid platform for transportation of the victim. It will be further appreciated that a rigid platform is desirable for purposes of performing lifesaving procedures such as cardiopulmonary resuscitation (CPR) without requiring the removal of the victim from the board 1000.

Figure 3:
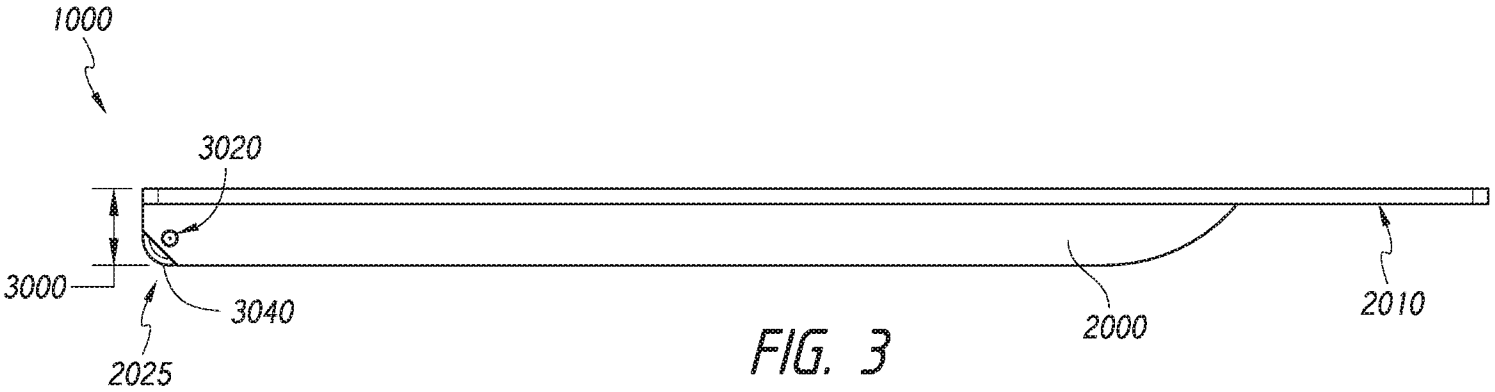
FIG. 3—A side view of certain embodiments
Figure 4:
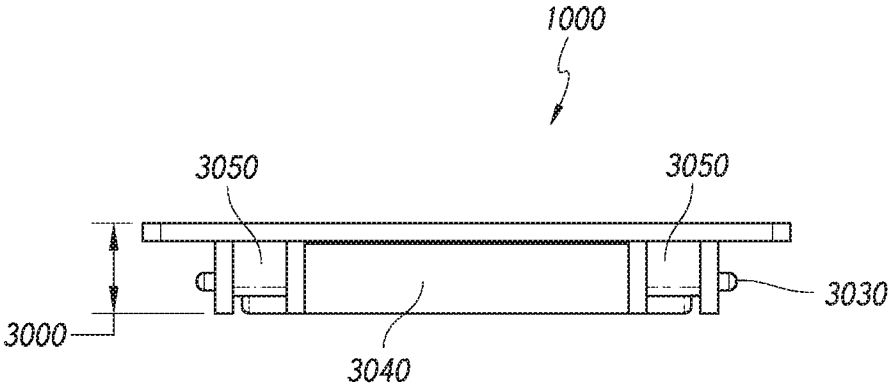
FIG. 4—A back view of certain embodiments
Figure 5:
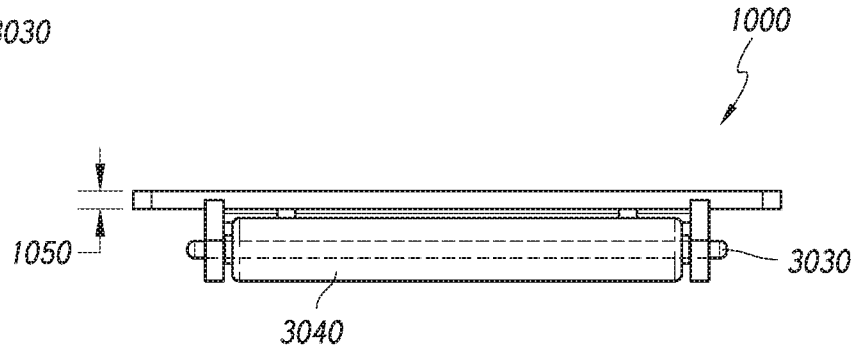
FIG. 5—A front view of certain embodiments
Figure 10A:
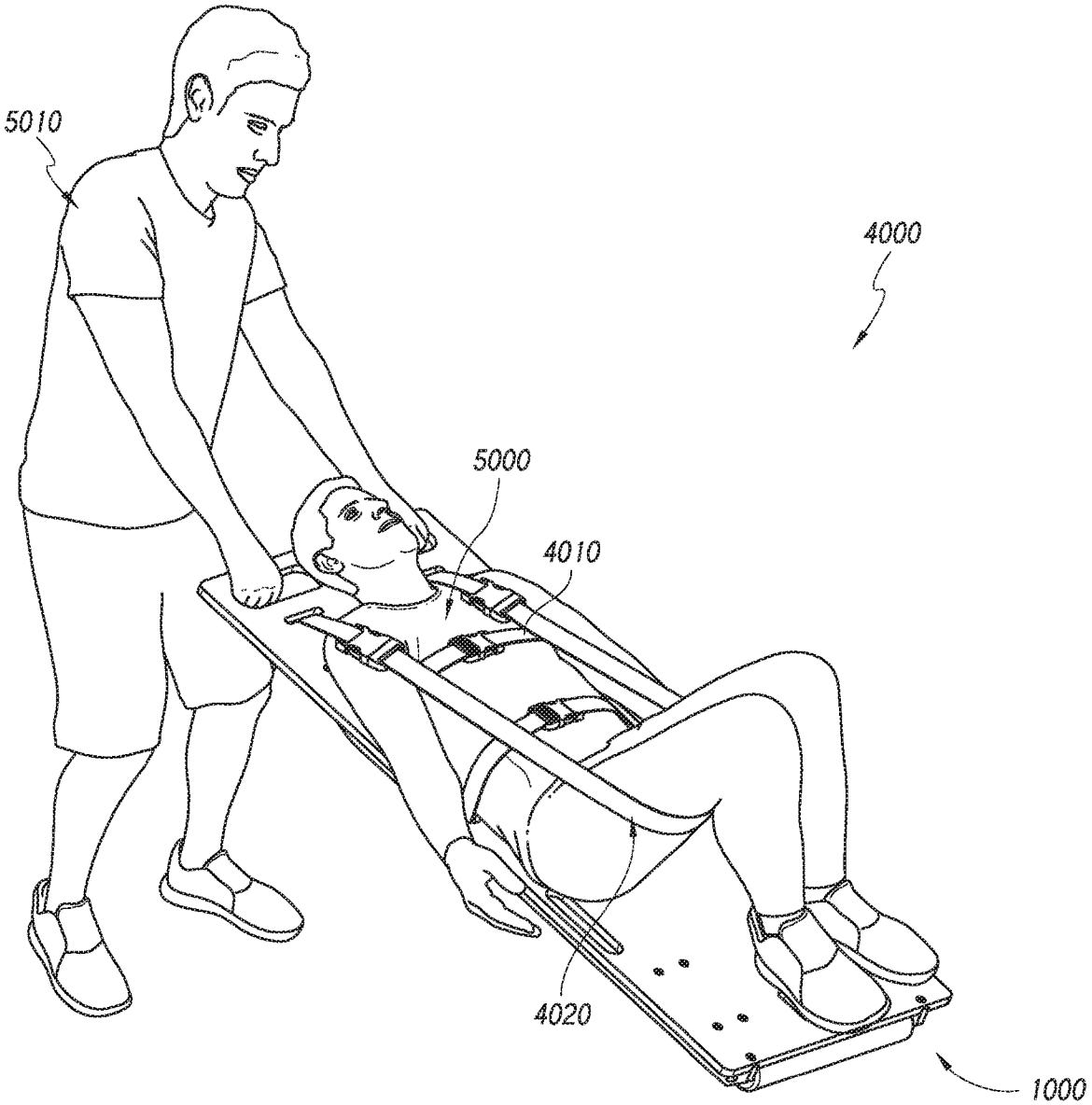
FIG. 10A—A perspective view of certain embodiments of the present invention in use for the transportation of a victim FIG. 10B—A perspective view of certain embodiments of the present invention in use for the transportation of a victim FIG. 11A—A top view of certain embodiments FIG. 11B—A bottom view of certain embodiments

In certain embodiments, seen in FIG. 3-FIG. 5 for example, the first end 2025 of a first rail 2000 and a second rail 2000 further comprise a hole 3020 configured to receive an axle 3030 allowing the mounting of a roller 3040. A roller 3040 disposed over an axle 3030 element is configured to engage with the ground when the second end 1020 of a board is elevated above the first end 1010 of the board. Although the roller 3040 as shown comprises a cylindrical roller disposed between rails 2000, it will be appreciated that a roller 3040 may comprise an elongated roller, or a wheel to provide mechanical advantage to a rescuer when transporting a victim in a dragging configuration 4000 (FIG. 10A). By engaging the roller 3040 with the ground, an individual is able to more easily transport a victim—who is affixed to the board. In certain embodiments, the first end 2025 of the rails 2000 further comprise a chamfer 2020, bevel or other edge treatment allowing the engagement of the roller 3040 with the ground only when used in a dragging configuration 4000.

Figure 7:
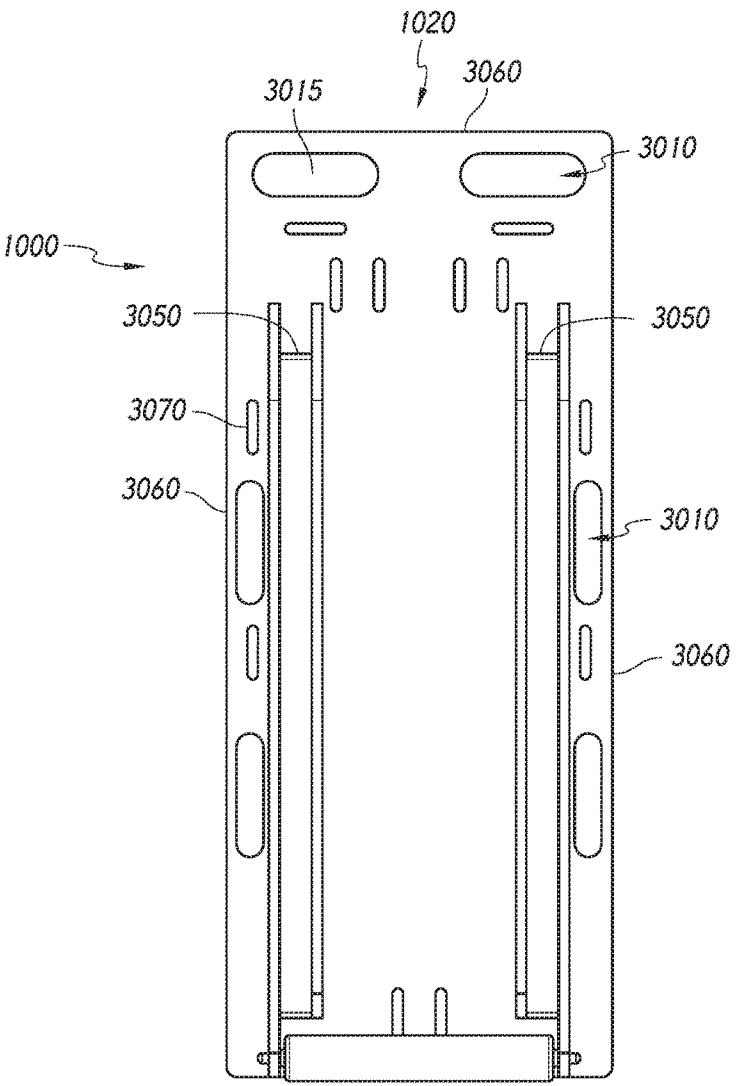
FIG. 7—A bottom view of certain embodiments

Certain embodiments—as shown in FIG. 2, FIG. 4, and FIG. 7—comprise a buoyancy feature 3050 configured to increase the buoyancy of a board. In certain embodiments, a buoyancy feature 3050 comprises materials having higher buoyancy than the board. It will be appreciated that a buoyancy feature 3050 may surround the use of a buoyant object or buoyant materials such as foam, enclosed air-bladders, captive air-pockets within the board, or other strategies for increasing buoyancy as appreciated by those skilled in the art. It will be appreciated that a buoyant material comprises a volumetric mass density less than the fluid it is placed in, such as water. Certain embodiments comprise buoyancy features 3050 constrained between a first rail 2000 and a second rail 2000. It will be appreciated that in certain embodiments it is desired that the buoyancy of the apparatus is configured such that the buoyancy force of the apparatus does not exceed the weight of a victim in a waterborne environment.

Certain embodiments comprising a board, further comprise handles 3010—as shown in FIG. 1, FIG. 2, FIG. 6 and FIG. 7. A handle 3010 of certain embodiments comprises an aperture 3015, oblong in shape and located proximal to an edge 3060 of the board. Furthermore, such handles 3010 are typically aligned having a length 3016 of the handle aligned with an edge 3060 of the board. Handles 3010 of certain embodiments are located proximal to a second end 1020 of the board to assist in the transport of a victim in a dragging configuration. Handles 3010 of some embodiments are proximal to a lateral edge 3060 of the board to assist in the transport of a victim when carrying the victim upon the board. Certain embodiments comprise two handles 3010 proximal to a second end 1020 of the board, two handles 3010 proximal to a first lateral edge 3060, and two handles 3010 proximal to a second lateral edge 3060 of the board.

Certain embodiments, such as shown in FIG. 6-FIG. 9, comprise tethering points 3070. It will be appreciated that for the purposes of the present invention, a tethering point 3070 surrounds a feature wherein a tether can be affixed. In certain embodiments, a tethering point 3070 comprises an aperture 3075 through a thickness 1050 (FIG. 5) of the board wherethrough a flexible length of strapping can be disposed to assist in the fixation of a victim to the board 1000, preferably in a manner to secure the victim to prevent further injury to the victim. In certain embodiments, as shown, the apertures 3075, comprise an elongated aperture.

Figure 10B:
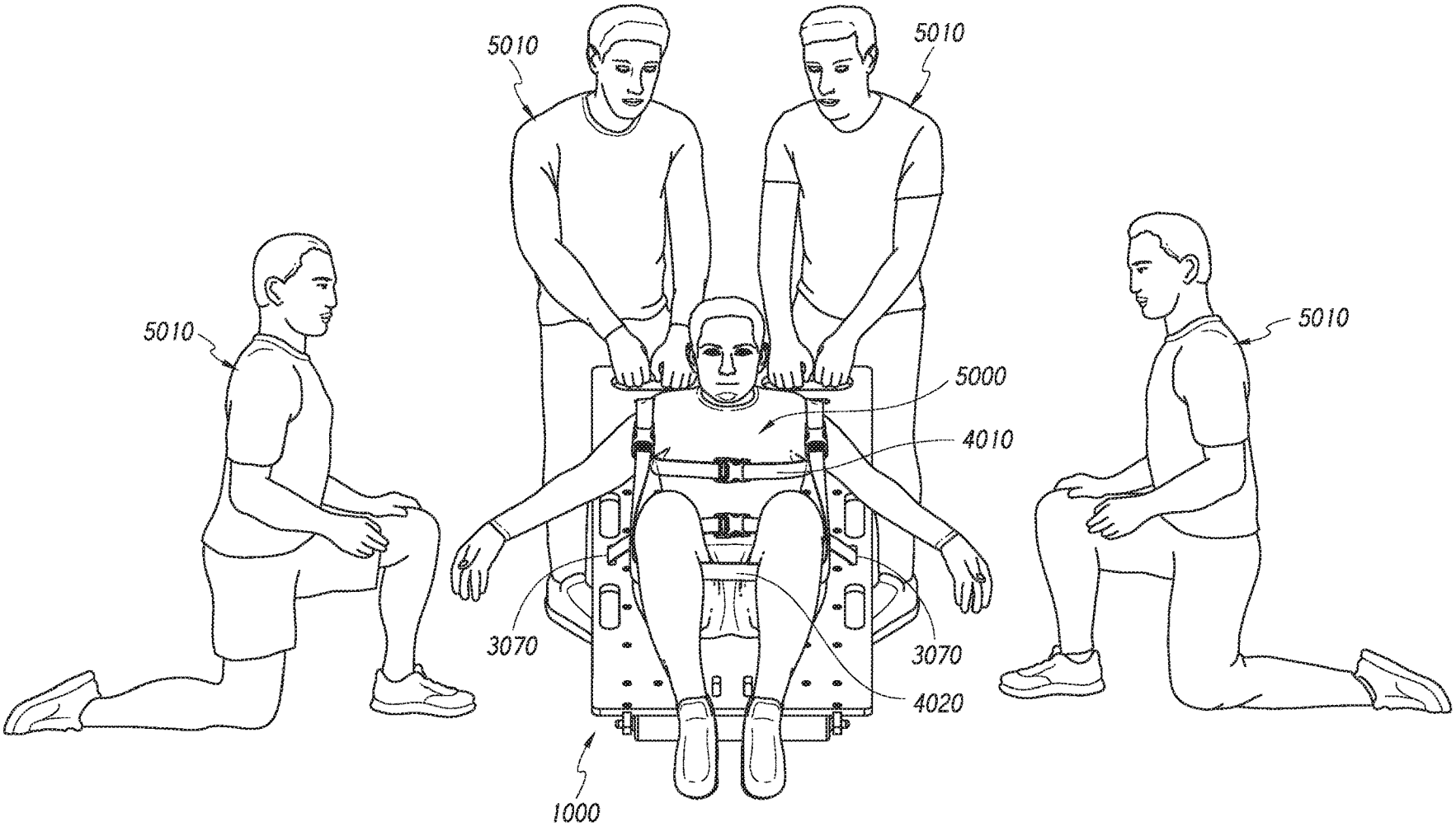

In certain embodiments, shown in FIG. 10A-FIG. 10B, a tether 4010 is configured to extend from a first tethering point 3070 adjacent to a first lateral edge 3060, to a second tethering point 3070 adjacent to a second lateral edge 3060, wherein the tether traverses a victim's torso therebetween.

Figure 6:
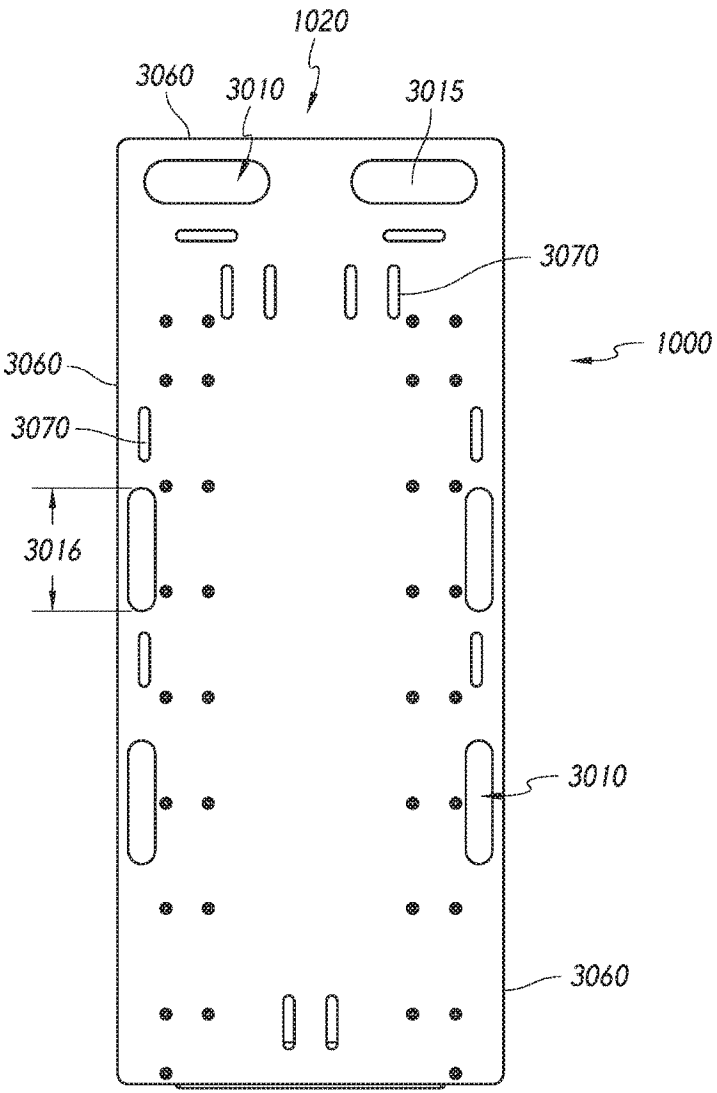
FIG. 6—A top view of certain embodiments
Figure 9:
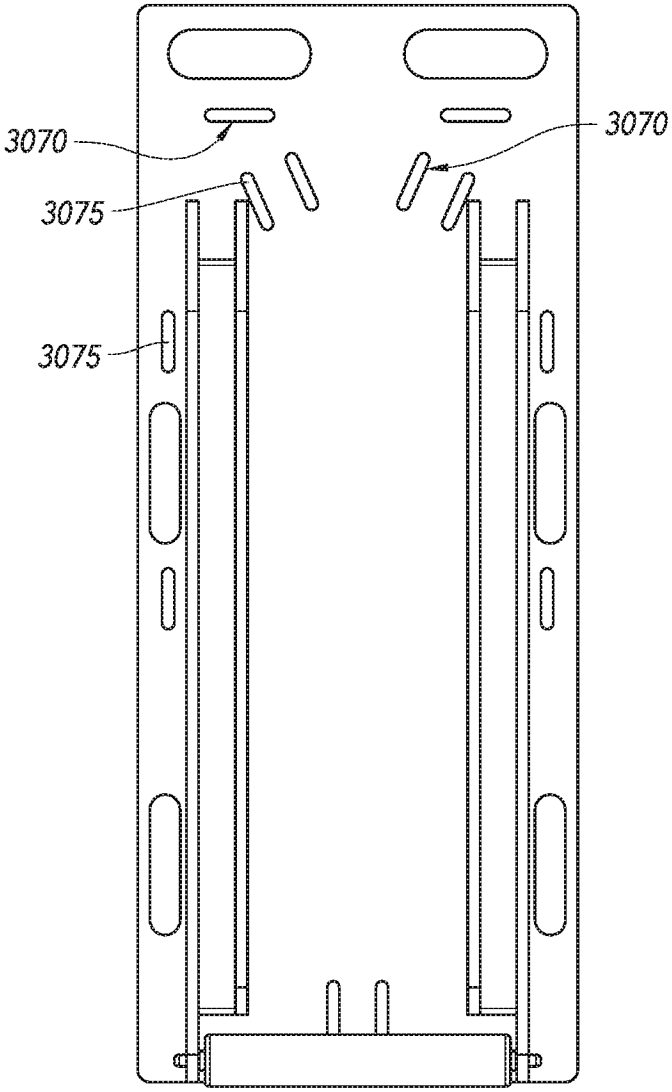
FIG. 9—A bottom view of certain embodiments
Figure 8:
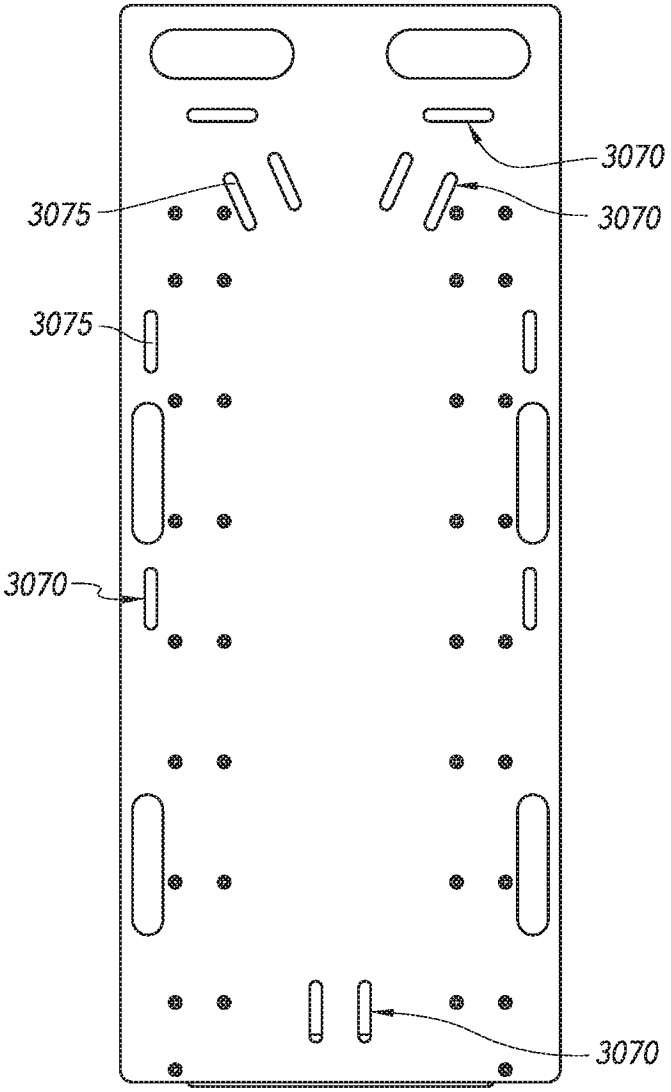
FIG. 8—A top view of certain embodiments

Certain embodiments, such as shown in FIG. 6-FIG. 7, comprise tethering points 3070 proximate to the first end 1010 of the board. Certain embodiments comprise tethering points proximate to the second end 1020 of the board. Certain embodiments comprise tethering points proximate to a lateral edge 3060 of the board.

The tethering points 3070 of certain embodiments, shown for example in FIG. 10A-FIG. 10B, are configured to allow multiple applications of tethers 4010 to a victim for increased fixation to the board. In certain embodiments, a first tether comprises a leg strap 4020 allows an individual to affix a victim in a configuration such that the victim's legs are held off the ground, allowing for increased mobility when transporting the victim—as seen in FIG. 10A-FIG. 10B. A leg strap 4020 allows the "bundling" of a victim 5000. The term "bundle", "bundled", or "bundling", as used herein, refers to preparing the victim 5000 in a manner to make their body more compact for ease of transport by rescuers 5010. In certain embodiments a victim's arms may be bundled to their torso so they do not impact objects during transport. A victim's legs impacting objects may result in further injury to the victim. Tethers 4010 having adjustable length, such as webbing or strapping, while affixed to the board 1000 are configured to be disposed behind the knees of the victim in order to bring the victim's thighs upward toward the victim's torso. By bundling a victim 5000, a rescuer 5010 can transport the victim in a more stable manner as the legs of the victim are contained rather than dragging when the board and victim are transported in a dragging configuration.

Certain embodiments comprise a tether 4010 configured as a chest strap 4030. A chest strap 4030 is configured to assist in affixing the victim 5000 to the board to secure the upper torso of the victim. Certain embodiments comprise a tether 4010 configured as a hip strap 4040. A hip strap 4040 is configured to assist in affixing the victim 5000 to the board to secure the lower torso of the victim.

Figure 11B:
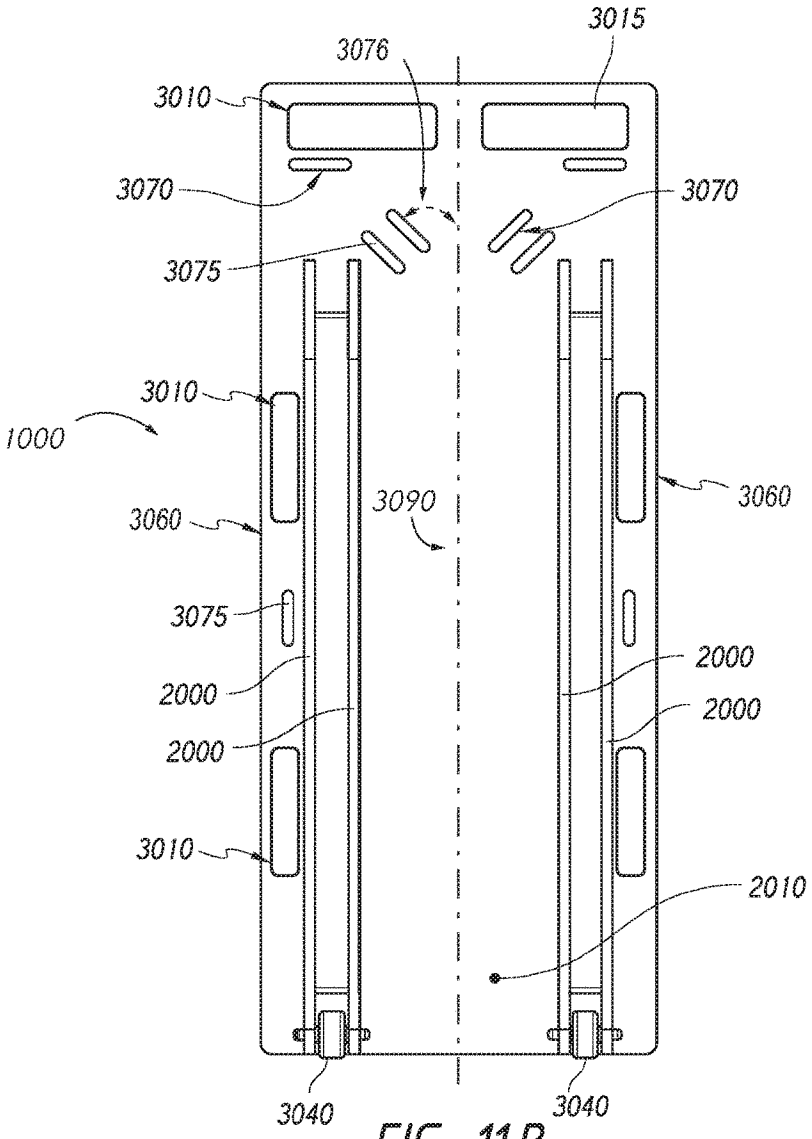
Figure 11A:
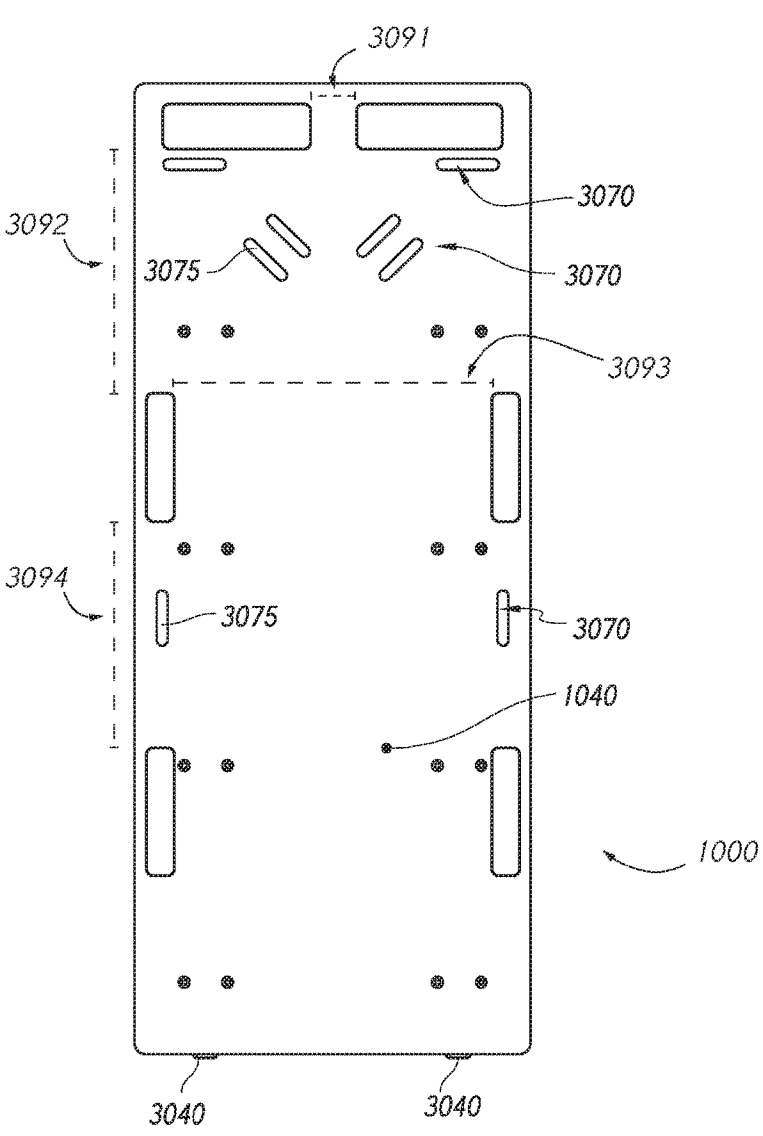

Certain embodiments, as shown in FIG. 11A-FIG. 11B, comprise a first roller 3040 affixed between a first rail 2000 and a second rail 2000. The roller 3040 of such embodiments comprises a wheel, such as shown in FIG. 11A-FIG. 11B. The first rail 2000 and the second rail 2000 comprise a hole 3020 configured to receive an axle 3030. The roller 3040, has a central hole therethrough configured to receive the axle 3030. Whereby, the roller 3030 is mounted to the axle 3030 and the axle affixed between the first rail 2000 and the second rail 2000. The roller 3040 is configured to engage with the ground when the second end 1020 of the board is elevated above the first end 1010 of the board. Certain embodiments comprise a first roller 3040, comprising a wheel, and a second roller 3040, comprising a wheel. The rollers 3040 of such embodiments allow for ease of pivoting while a victim is affixed to the board 1000.

Certain embodiments, shown in FIG. 11A-FIG. 11B, comprise a first tethering point 3070 offset from a longitudinal axis 3090 to a first side, and a second tethering point offset from a longitudinal axis 3090 to a second side. Tethering points can be used for affixing a chest strap 4030 configured to go under a victim's arms and over their chest, as a leg strap 4020 configured to go behind the knees for bundling, around a victim's waist, or other configurations as appreciated by one skilled in the art. In certain embodiments the tethering points 3070 comprise an aperture 3075.

In certain embodiments, such as shown in FIG. 11A-FIG. 11B, a first pair of handles located proximal to the second end of the board have a lateral offset 3091 between a first handle 3010 and a second handle 3010. The lateral offset 3091 of certain embodiments is approximately 5.1 cm (2 inches). Certain embodiments comprise a second pair of handles 3010 having a first handle 3010 proximal to a first lateral edge 3060 and a second handle 3010 proximal to a second lateral edge, and the first handle having a lateral offset 3093 from the second handle. The lateral offset 3093 of certain embodiments is 30.5 cm (12 inches). The second pair of handles have a longitudinal offset 3092 from the first pair of handles 3010. The longitudinal offset 3092 of certain embodiments is approximately 25.4 cm (10 inches). Certain embodiments comprise a third pair of handles 3010 having a first handle 3010 proximal to a first lateral edge 3060 and a second handle 3010 proximal to a second lateral edge, and the first handle having a lateral offset 3093 from the second handle. The third pair of handles 3010 have a longitudinal offset 3094 from the second pair of handles 3010. The longitudinal offset 3094 of certain embodiments is 33.0 cm (13 inches).

In certain embodiments, the tethering points 3070 comprise a first aperture 3075 and a second aperture 3075. In certain embodiments, such apertures configured to affix a tether for traversing under a victim's arm and over their chest. Certain embodiments of such tethering points 3075 have a lateral offset 3091 of 5.1 cm (2 inches).

It will be appreciated that the dimensions and offsets disclosed herein are not intended to be limiting to all embodiments. It will be appreciated that longitudinal offsets, lengths, and widths can be modified as desired while in keeping with the spirit and scope of the present invention.

In certain embodiments, as shown in FIG. 10A-FIG. 10B, a tether 4010 comprises a length of flexible tensile bearing material such as cordage, strapping, webbing or other tensile bearing material appreciated by those skilled in the art. In certain embodiments, the tether 4010 comprises an integral loop at a first end. The integral loop is configured to pass through a first aperture 3075 (FIG. 11A-FIG. 11B) of the board from the second surface of the board 1040 to the first surface 2010 of the board, a second end of the length of the tether 4010 is then passed through the integral loop, whereby the tether 4010 is affixed to the board 1000. In certain embodiments, shown in FIG. 11A-FIG. 11B, a board comprises a first aperture and a second aperture in near proximity to each other, such as apertures 3075 configured for disposed at an angle 3076. In such embodiments, a first end of a tether 4010 comprising an integral loop is passed through a first aperture 3075 from a second surface 1040, and then passed through the second aperture 3075 from the first surface 2010 back to the second surface 1040. A second end of the tether 4010 is then passed through the integral loop, thereby affixing the tether 4010 to the board. In certain embodiments a first tether 4010 comprises a first buckle 4015 at a second end, and a second tether 4010 comprising a second buckle 4105 second end, wherein the first buckle and is configured to affix to the second buckle.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. An apparatus for the extrication of a victim comprising:

a board;

a first roller and a second roller affixed proximally to first end of the board, the rollers disposed between a first rail and a second rail, the rails affixed to a first side of the board;

the rails extending from proximal to the first end of the board toward a second end of the board;

a first handle proximal to the second end of the board; and a first pair of tethering points proximal to the first handle and longitudinally located between the first handle and the first end of the board, the first pair of tethering points offset laterally from a longitudinal axis in a first direction and a second direction;

wherein the rails are configured to rest on the ground to provide an offset between the first side of the board and the ground, wherein the rollers do not engage with the ground when the rails rest on the ground, and wherein the rollers are configured to engage with the ground only when the second end of the board is elevated above the first end of the board in a dragging configuration.

2. The apparatus of claim 1, further comprising a second pair of tethering points, offset laterally from the longitudinal axis in the first direction and the second direction;

the second pair of tethering points longitudinally located between the first pair of tethering points and the first end of the board;

a third pair of tethering points, offset laterally from the longitudinal axis in the first direction and the second direction;

the third pair of tethering points longitudinally located between the second pair of tethering points and the first end of the board;

a second handle proximal to a first lateral edge of the board longitudinally offset toward the first end of the board from the first handle; and a third handle proximal to a second lateral edge of the board longitudinally offset toward the first end of the board from the second handle.

3. The apparatus of claim 2, furthering comprising a buoyancy feature having a volumetric mass density less than that of water; and the buoyancy feature is affixed to the first side of the board.

4. The apparatus of claim 3, wherein the buoyancy feature is configured to be disposed between the first rail and the second rail.

5. The apparatus of claim 2, further comprising a third rail and a fourth rail, the third and fourth rails extending from proximal to the first end of the board toward the second end of the board;

the first rail proximal to the first lateral edge of the board;

the second rail proximal to the second lateral edge of the board;

the third rail being laterally offset toward the longitudinal axis from the first rail;

the fourth rail being laterally offset toward the longitudinal axis from the second rail;

the first roller is disposed between the first rail and the third rail; and the second roller is disposed between the second rail and the fourth rail.

6. The apparatus of claim 5, furthering comprising a first buoyancy feature and a second buoyancy feature, the buoyancy features having a volumetric mass density less than that of water;

the first buoyancy feature configured to be constrained between the first rail and the third rail; and the second buoyancy feature configured to be constrained between the second rail and the fourth rail.

7. The apparatus of claim 6, wherein the rails further comprise a chamfer at a first end; and a taper at a second end of the rails.

8. The apparatus of claim 2, wherein the rails further comprise a chamfer at a first end; and a taper at a second end of the rails.

9. The apparatus of claim 2, wherein the board has a length of less than 121.9 cm (48 inches).

10. The apparatus of claim 2, further comprising a fourth handle laterally offset from the first handle, and proximal to the second end of the board;

a fifth handle proximal to the first lateral edge of the board, and longitudinally offset from the second handle; and a sixth handle proximal to the second lateral edge of the board, and longitudinally offset form the third handle.

11. The apparatus of claim 10, wherein the first handle and the fourth handle are laterally aligned, the second handle and the fifth handle are laterally aligned; and the third handle and the sixth handle are laterally aligned.

12. The apparatus of claim 2, wherein the tethering points comprise apertures through the board; and the handles comprise apertures through the board.

13. The apparatus of claim 12, further comprising a plurality of tethers;

the plurality of tethers comprising a length of tensile bearing material having a first end having an integral loop, and a second end having a buckle.

14. The apparatus of claim 12, wherein the second pair of tethering points comprises a first tethering point and a second tethering point;

the first tethering point of the second pair of tethering points comprising a first elongated aperture, and a second elongated aperture, wherein the elongated apertures of the first tethering point are adjacent and parallel to each other; and the second tethering point of the second pair of tethering points comprising a first elongated aperture, and a second elongated aperture, wherein the elongated apertures of the second tethering point are adjacent and parallel to each other.

15. The apparatus of claim 14, wherein the first tethering point of the second pair of tethering points is disposed at an angle of 45-degrees in the first direction from the longitudinal axis; and the second tethering point of the second pair of tethering points is disposed at an angle of 45-degrees in the second direction from the longitudinal axis.

16. An apparatus for the extrication of a victim comprising:

a board;

a roller affixed proximally to first end of the board, the roller disposed between a first rail and a second rail, the rails affixed to a first side of the board;

the rails extending from proximal to the first end of the board toward a second end of the board;

a first handle proximal to the second end of the board;

a first pair of tethering points proximal to the first handle and longitudinally located between the first handle and the first end of the board, the first pair of tethering points offset laterally from a longitudinal axis in a first direction and a second direction; and a buoyancy feature, the buoyancy features having a volumetric mass density less than that of water, wherein the rails are configured to rest on the ground to provide an offset between the first side of the board and the ground, wherein the roller does not engage with the ground when the rails rest on the ground, and wherein the roller is configured to only engage with the ground when the second end of the board is elevated above the first end of the board in a dragging configuration.

17. The apparatus of claim 16, further comprising a second pair of tethering points, offset laterally from the longitudinal axis in the first direction and the second direction;

the second pair of tethering points longitudinally located between the first pair of tethering points and the first end of the board;

a third pair of tethering points, offset laterally from the longitudinal axis in the first direction and the second direction;

the third pair of tethering points longitudinally located between the second pair of tethering points and the first end of the board;

a second handle proximal to a first lateral edge of the board longitudinally offset from the first handle; and a third handle proximal to a second lateral edge of the board longitudinally offset from the first handle.

18. An apparatus for the extrication of a victim comprising:

a board having a length of less than 121.9 cm (48 inches), a first pair of rails comprising a first rail and a second rail, coincident with a first surface of the board, laterally inset from and parallel to lateral edges of the board;

a first end of the first pair of rails coincident with a first end of the board, and a second end of the first pair of rails offset from a second end of the board;

the second end of the first pair of rails having a tapering profile;

a second pair of rails comprising a third rail and a fourth rail, coincident with the first surface of the board, laterally inset from and parallel to the first pair of rails;

a first end of the second pair of rails offset from the first end of the board, and a second end of the second pair of rails aligned with the second end of the first pair of rails;

a first plurality of handles extending from the first surface to a second surface of the board, proximally located to the first end of the board;

a second plurality of handles through the board, proximal to the lateral edges of the board;

a plurality of tethering points;

a roller affixed between the first pair of rails, proximally located to the second end of the board, and perpendicular to the lateral edges of the board; and a first buoyancy feature disposed between the first pair of rails, and a second buoyancy feature disposed between the second pair of rails, the buoyancy features having a volumetric mass density less than that of water, wherein the rails are configured to rest on the ground to provide an offset between the first side of the board and the ground, wherein the roller does not engage with the ground when the rails rest on the ground, wherein the second surface of the board is configured to receive a victim and tethers disposed through the tethering points are configured to affix a victim to the second surface of the board, and wherein the roller is configured to only engage with the ground when the second end of the board is elevated above the first end of the board in a dragging configuration.

* * * * *